US005906292A

United States Patent [19]

Rider, Jr.

[11] Patent Number: 5,906,292

[45] Date of Patent: May 25, 1999

[54] LATCH FOR CONTAINER

[75] Inventor: Edward W. Rider, Jr., Slate Hill, N.Y.

[73] Assignee: Genpak, L.L.C., Glens Falls, N.Y.

[21] Appl. No.: 08/916,080

[22] Filed: Aug. 21, 1997

[51] Int. Cl.[6] ..... B65D 43/16

[52] U.S. Cl. ..... 220/839; 206/508; 220/4.23; 220/324; 220/556; 220/839; 229/407

[58] Field of Search ..... 229/406, 407; 220/4.22, 4.23, 324, 555, 556, 339, 366.1, 203.04, 203.09, 839, 837, 841; 206/508

[56] References Cited

U.S. PATENT DOCUMENTS

| | | | |
|---|---|---|---|
| 3,968,921 | 7/1976 | Jewell | 220/406 |
| 4,057,169 | 11/1977 | Payne | 220/4.23 |
| 4,079,880 | 3/1978 | Edwards . | |
| 4,582,248 | 4/1986 | Bixler et al. | 229/406 |
| 4,684,024 | 8/1987 | Ebrahim et al. | 220/324 X |
| 4,787,552 | 11/1988 | Natori | 220/4.23 |
| 5,012,928 | 5/1991 | Proffitt et al. | 206/508 |
| 5,131,551 | 7/1992 | Wells | 220/4.23 |
| 5,695,087 | 12/1997 | Tutton et al. | 220/324 |

*Primary Examiner*—Stephen K. Cronin
*Assistant Examiner*—Robin Hilton
*Attorney, Agent, or Firm*—Heslin & Rothenberg, P.C.; Wayne F. Reinke, Esq.

[57] ABSTRACT

A formed plastic container having a cover portion and a bottom portion, also includes a latch. The latch has a projection extending out from the cover, and a locking flap extending out from the bottom that flexes to meet and hold the projection. In one embodiment, the projection includes a tab, and the locking flap includes a rib that lifts the flap above the tab when closed, in order to reduce the possibility of the tab coming away from the flap.

13 Claims, 6 Drawing Sheets

LATCH FOR CONTAINER

BACKGROUND OF THE INVENTION

1. Technical Field

The present invention generally relates to container latches. More particularly, the present invention relates to a container latch comprising a closing projection, and a locking flap with an aperture for accepting the projection and a rib for maintaining the closing projection within the aperture.

2. Background Information

FIGS. 1–3 depict an existing container 5 made of polystyrene foam. Container 5 includes a latch 22 with projection 24 having an overhanging structure and a locking flap 38. Latch 22 is shown in FIG. 1 in a second locking position. A first locking position is achieved when locking flap 38 is placed only over a tab 32 (see FIG. 2). Although the second locking position is more secure than the first, the second locking position takes more effort to achieve.

Users of container 5 often find it desirable to use the latch in the first locking position, rather than the second locking position for various reasons. However, it has been discovered through experience that the first locking position may not be secure enough for some purposes, for example, transporting foods including a sauce.

Thus, a need exists for a container latch with improved security in a simple-to-achieve locking position.

SUMMARY OF THE INVENTION

Briefly, the present invention satisfies the need for an improved container latch by providing a locking flap with a ridge, enhancing the ability of the closing projection to remain within the locking flap aperture.

In accordance with the above, it is an object of the present invention to provide a more secure container latch.

The present invention provides, in a first aspect, a latch for a container including a cover portion and a bottom portion. The latch comprises a closing projection extending out from a periphery of the cover or bottom portion, and a locking flap extending out from a periphery of the other portion. The locking flap comprises an aperture for accepting the closing projection, and a rib for maintaining the closing projection in the locking flap when accepted therein in a first locking position.

The present invention provides, in a second aspect, a container comprising the latch of the first aspect.

These, and other objects, features and advantages of this invention will become apparent from the following detailed description of the various aspects of the invention taken in conjunction with the accompanying drawings.

BEST MODE FOR CARRYING OUT THE INVENTION

Figure 1:
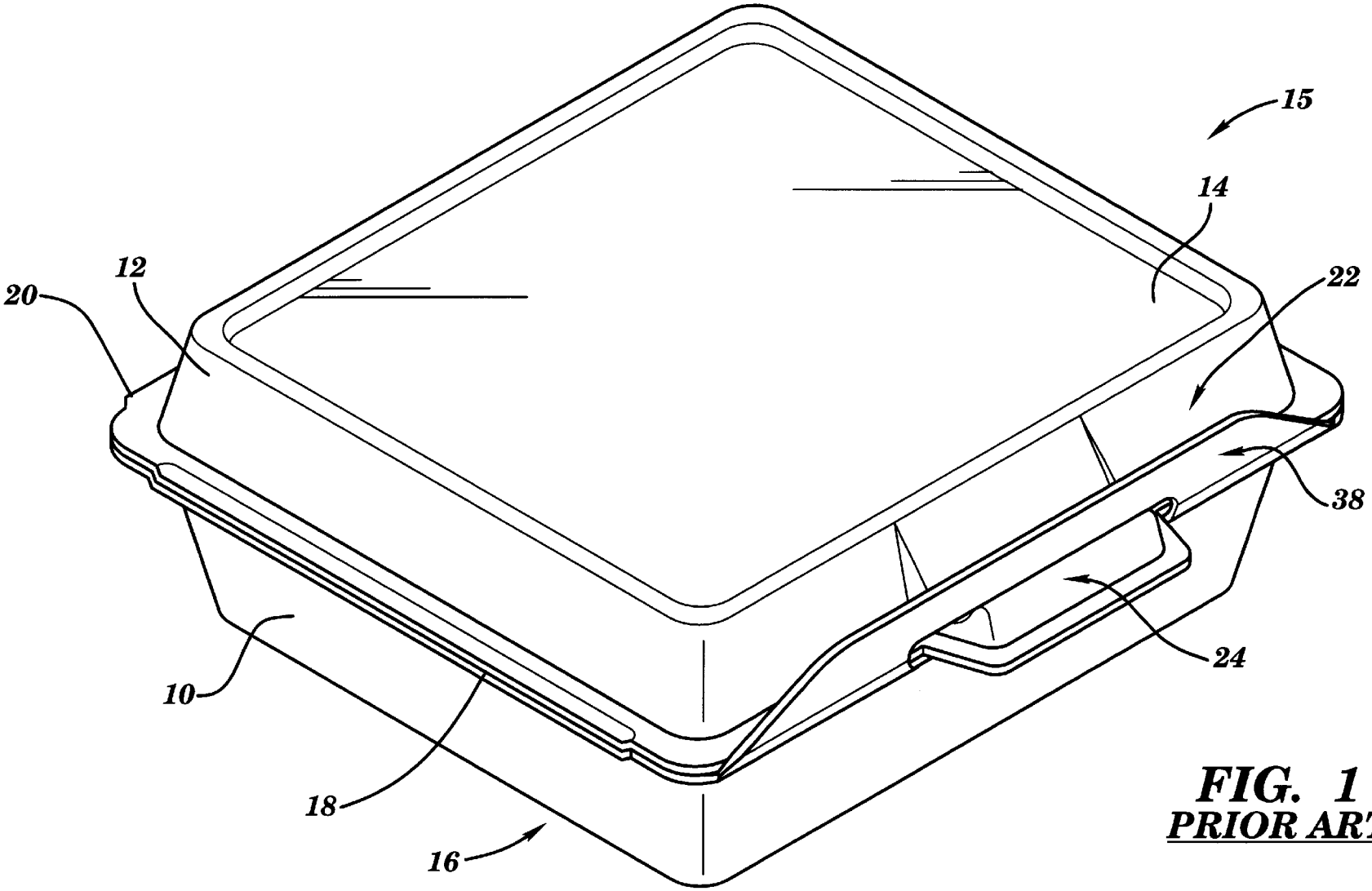
FIG. 1 PRIOR ART
FIG. 1 depicts an existing polystyrene foam container with a latch shown in a second or fully locked position.
Figure 2:
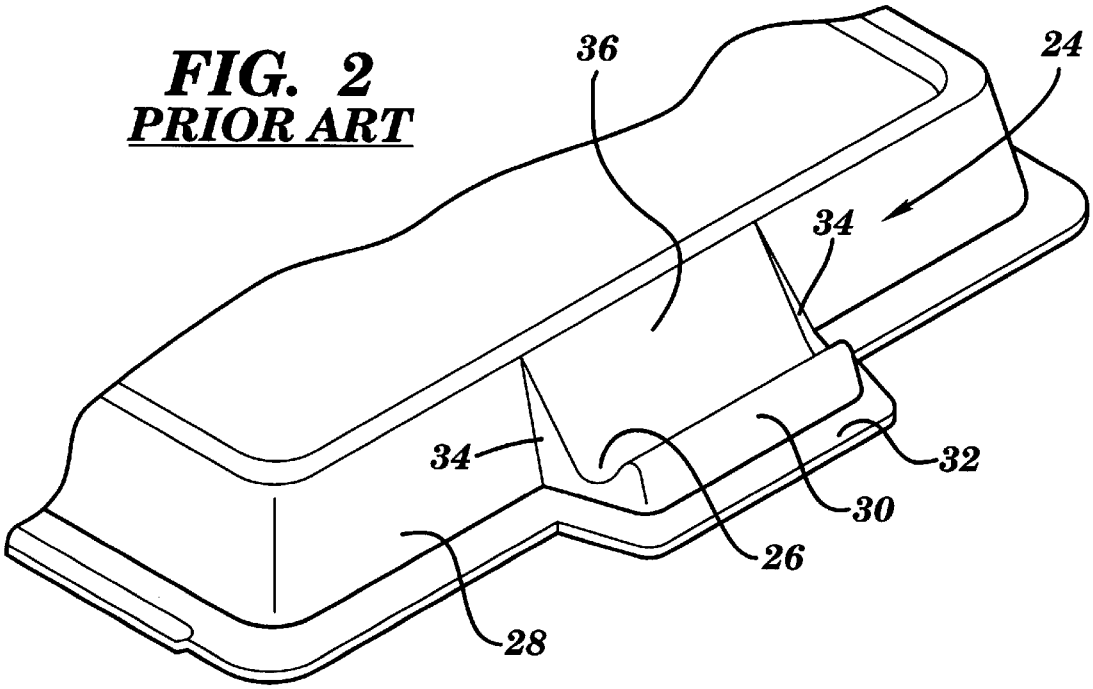
FIG. 2 PRIOR ART
FIG. 2 is a top perspective view of the closing projection portion of the latch on the container of FIG. 1.
Figure 3:
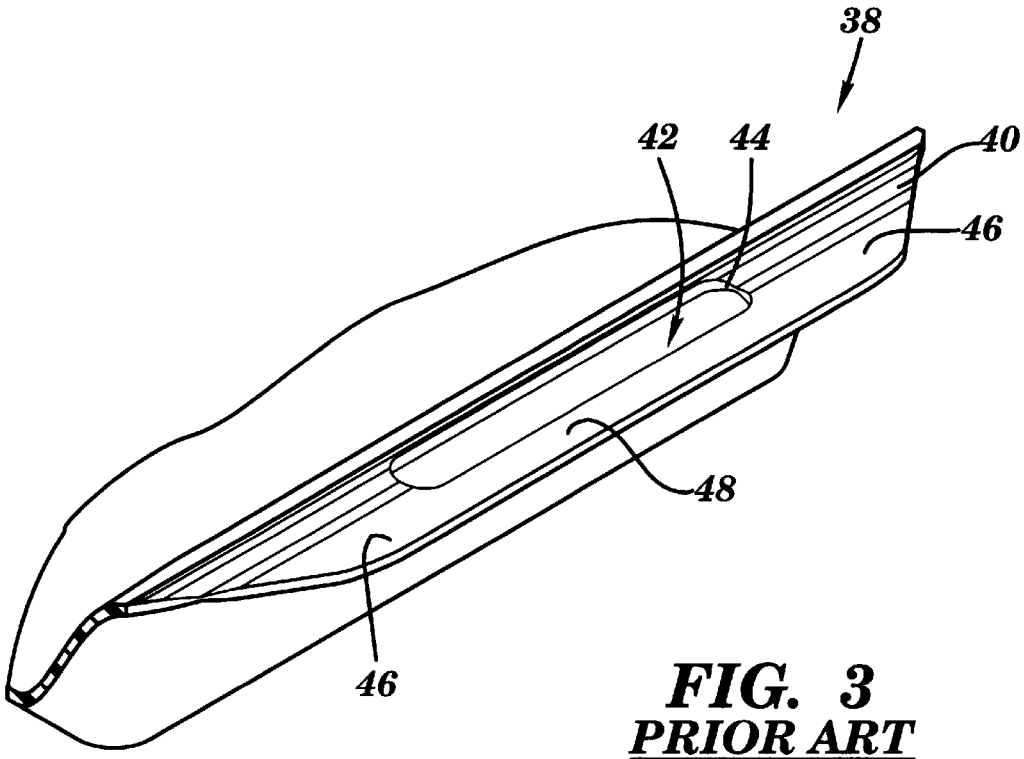
FIG. 3 PRIOR ART
FIG. 3 is a top perspective view of the locking flap portion of the latch on the container of FIG. 1.

FIGS. 1–3 depict a prior art food package 5 made by a forming process (e.g., thermoforming) from, for example, foamed polystyrene sheet material. As shown from the general view of FIG. 1, the package comprises a base component 10 and a lid component 12. Each component is of general square shape in plan view and comprises four sloping sidewalls which converge upon a top surface 14 and bottom surface 16. The sidewalls terminate in an outstanding surrounding lip 18 which provides a stiffening function to the component. The two components are formed integrally and are joined together along the rear sidewalls by a hinge 20.

The package is also provided with a locking means for holding the components together in a closed position of the package. This locking means, generally indicated by numeral 22, is disposed upon the two front sidewalls of the component directly opposite to the hinge 20. On the lid component 12, the locking means comprises a locking projection 24 in the form of a valley 26, the valley extending alongside and spaced from its associated front sidewall 28. The valley has a peak that merges smoothly with a shoulder 30. The shoulder 30 extends upwardly from a tab 32, i.e. towards top 14, and a closing wall 34 is provided at each end of the shoulder, the wall 34 extending upwardly to close the ends of the valley 26 so that a particularly stiff and robust projection construction is provided. The shoulder 30 extends from the tab 32 towards the top 14 of the lid component for a short distance with the valley 26 extending further towards the top 14. The shoulder 30 is joined to the front sidewalls 28 by means of a buttress formation 36 formed outwardly from the sidewall so that the shoulder is joined to the sidewall down the depth of the shoulder, i.e. in a direction towards the top 14.

The locking means also comprises a locking flap 38 which is formed upon the base component 10. The locking flap 38 is hinged about a pivotal axis 40 off lip 18. The flap has an aperture 42 defined by a flap aperture border 44 of the flap. The flap is elongated along one side of the pivotal axis and is of such dimensions that upon pivoting the flap from a normal position in which it lies substantially in the plane of the lip 18 through an upward angle of approximately 90°, the aperture will pass over the shoulder 30 and into valley 26 of the lid component. The flap aperture border comprises two arms 46 extending from the pivotal axis, and a bridging piece 48 which extends along the long side of the aperture 42 remote from the axis. With the flap in the position shown in FIG. 1, which is the package locking (or second) position of the flap, the bridging piece 48 lies in the valley 26 provided between the shoulder 30 and the buttress formation 36.

In the use of the package, when contents are placed inside the base component 10 and the lid component 12 is closed upon the base component, the two components are locked together with the locking means. The flap of the locking means is pivoted from a free hanging position (not shown) into the position in FIG. 1 with the flap in the locking position. To achieve this, it is necessary for the shoulder 30 to pass through the aperture 15. However, the design of the locking means is such that the shoulder/valley peak in the normal position of the projection lies in the path of the bridging piece 48 so that is its not completely free to pass through it. To enable the peak to pass through the aperture, it is necessary manually to flex the front sidewall of either the container base or the lid component so that slight relative movement vertically between the projection and the flap takes place. This causes the peak to pass through the aperture so that the flap passes into the valley 26, thus disposing the peak and the projection from one side of the flap to the other. Alternatively, to locate the flap in the position shown in FIG. 1, it may be found possible to flex the bridging piece 48 slightly to enable it to pass over the peak so that pressure upon the sidewalls may not be necessary.

It is found that when the flap is in the locking position shown in FIG. 1, a particularly robust and stiff lock is provided for holding a package closed. Once the peak of the projection is located with the flap border in the valley 26 there is no natural tendency for the locking means to unlock and a definite step has to be taken before the flap may be returned to its unlocked position. In order to assist the projection from being pushed back through the aperture in an unlocking movement, the shoulder 30 is joined in the vertical direction towards the top 14 of the lid component by the buttress 36. There is, therefore, a very strong resistance to bending of the projection upon the front sidewall 28 so that the flap cannot merely push the projection downwards, thus preventing flap movement back into the unlocked position. Further to this, as can be seen from FIG. 1, the bridging piece 48 of the flap aperture border extends substantially vertically which means that any force applied to the package in the opening sense will be placed upon the flap in the plane of the aperture and also in the plane of the border 16 so that this force is taken upon the full width of the bridging piece 48 and upon the arms 46. Obviously, the width of the bridging piece and the arms is far greater than the thickness of foam material so that the load imposed is quite easily dissipated throughout the material without distortion or breakage thereof.

Figure 4:
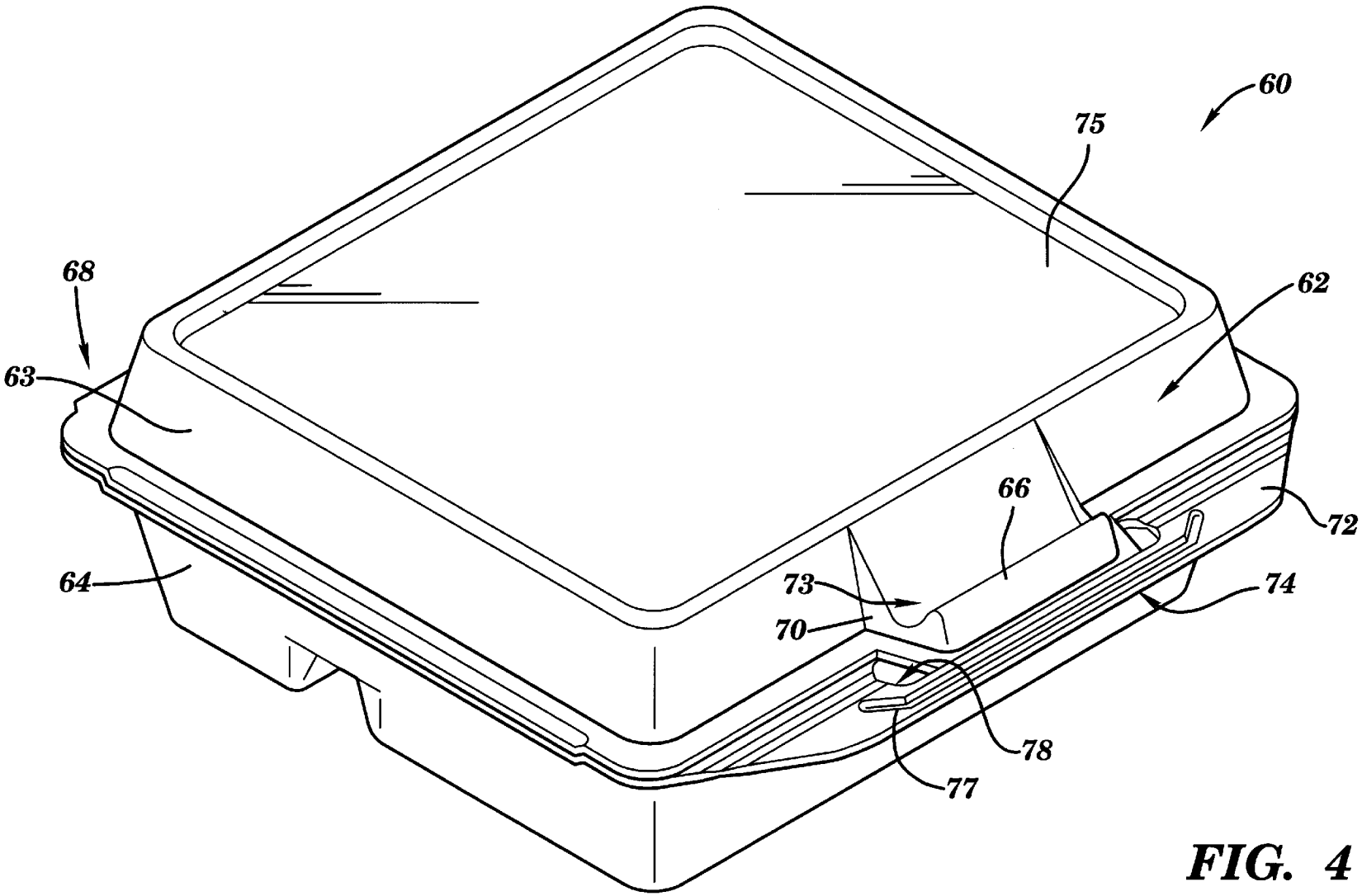
FIG. 4 depicts a container with a latch according to the present invention shown in a first or partially locked position.

The improvement to the container 5 of FIG. 1 will now be described in detail. FIG. 4 is a top perspective view of a container 60 with a latch 62 according to the present invention. Container 60 comprises a cover portion 63 and bottom portion 64. Cover portion 63 and bottom portion 64 are connected by hinge 68 (shown best in FIG. 7). Latch 62 is shown in a first locking position (the second locking position is the same as that shown in FIG. 1). Latch 62 comprises closing projection 70, which includes shoulder 66, recess 73 and a tab 74 (shown in FIG. 5), and locking flap 72. Closing projection 70 is similar to that shown in FIG. 3. However, locking flap 72 comprises a rib (see FIG. 5) (76) protruding downward toward tab 74 that makes the first locking position more secure. Indent 77 on locking flap 72 creates the rib. With the rib, it is less likely that tab 74 will slip out of aperture 78 in locking flap 72. Also shown in FIG. 4 is a recessed top 75 that allows the stacking of containers like container 60.

Although the second locking position is generally more secure than the first locking position, the first locking position is often adequate for the particular circumstances. In addition, the first locking position takes less effort to achieve than the second locking position, since locking flap 72 needs to be moved past shoulder 66 and into recess 73. Container 60 is preferably made of a foamed plastic material suitable for the particular use. For example, if container 60 were used as a food container, the foam could be, for example, poly(ethylene teraphthalate) or polystyrene. However, it will be understood that container 60 could be made of other types of foamed plastic, as well as unfoamed plastic or other materials.

Figure 5:
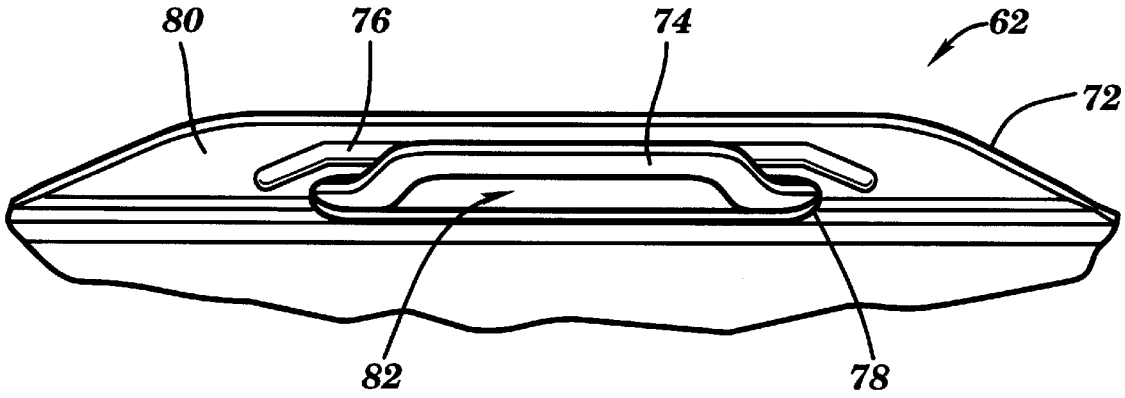
FIG. 5 is a bottom plan view of the container latch of FIG. 4.

FIG. 5 is a bottom plan view of latch 62 from FIG. 4 in the first locking position. As best appreciated from FIG. 5, rib 76 protrudes from the underside 80 of locking flap 72 and keeps the locking flap raised above the top surface of tab 74, and creates a barrier (analogous to a speed bump for a car) that the tab must overcome in order to detach from locking flap 72. When latch 62 is in either locking position, an opening 82 is created into container 60 by the overhanging structure of closing projection 70 and aperture 78. In the present exemplary embodiment, rib 76 is created by indenting or recessing the flap on the opposite side (see FIG. 4). However, one skilled in the art will recognize that there are other ways to create the rib.

Figure 6:
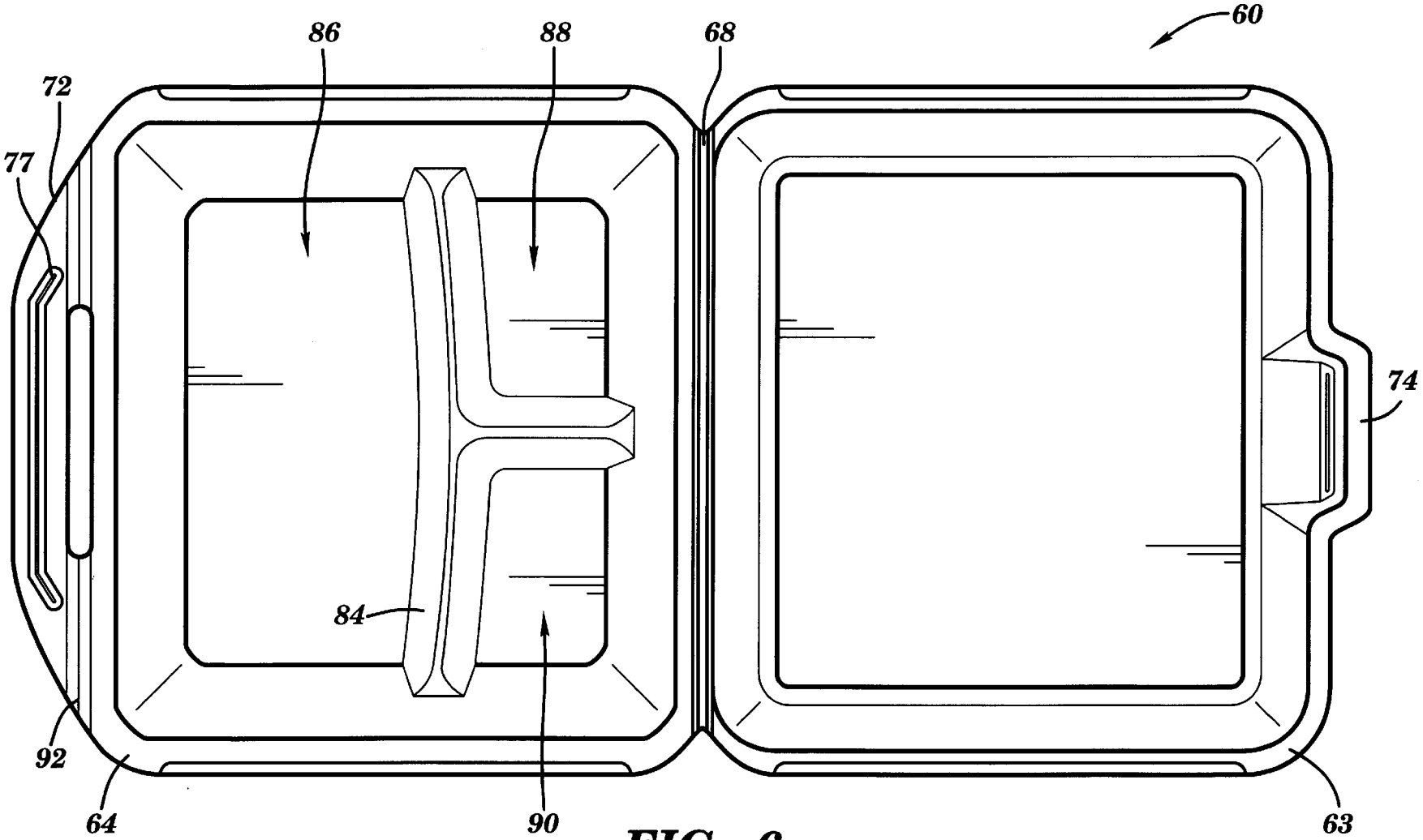
FIG. 6 is a top plan view of the container of FIG. 4 shown fully opened.

FIG. 6 is a top plan view of the container 60 of FIG. 4 shown fully opened. The cover portion 63 and bottom portion 64 are connected by hinge 68. Bottom portion 64 is compartmentalized via divider 84, with compartments 86, 88 and 90. It will be understood that bottom portion 64 need not be compartmentalized, and that if it is, it could have more, less, or different shaped and/or sized compartments. As best shown in FIG. 6, locking flap 72 is aided in movement by a thinning of the container material in a fold area 92.

Figure 7:
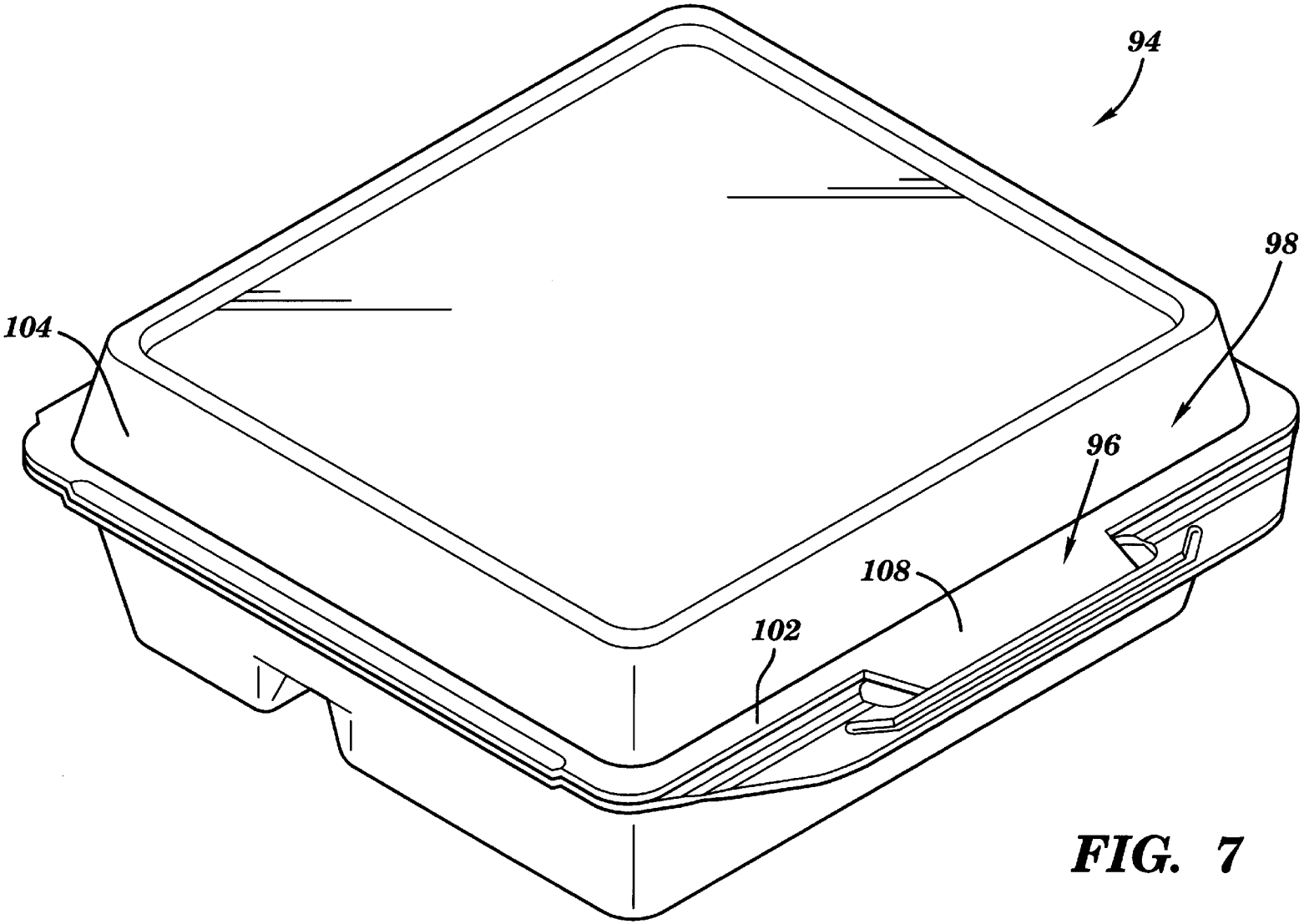
FIG. 7 is another embodiment of a container with a latch according to the present invention.

FIG. 7 is a top perspective view of another embodiment of a container 94 with a latch in accordance with the present invention. Container 94 is similar to container 60 of FIG. 4, except that closing projection 96 of latch 98 takes the form of a tab 108 extending out from a periphery 102 of container cover 104, rather than taking the form of the overhanging structure of closing projection 70 of FIGS. 4 and 5. Thus, latch 98 of container 94 is capable of assuming only the first locking position, and not the second.

While several aspects of the present invention have been described and depicted herein, alternative aspects may be effected by those skilled in the art to accomplish the same objectives. Accordingly, it is intended by the appended claims to cover all such alternative aspects as fall within the true spirit and scope of the invention.

I claim:

1. A latch for a container including a cover portion and a bottom portion, the latch comprising:

a closing projection extending out from a periphery of one of the cover portion and bottom portion; and a locking flap extending out from a periphery of the other of the cover portion and bottom portion, the locking flap comprising an aperture for accepting the closing projection and a rib situated on a face of the locking flap facing toward the other of the cover portion and the bottom portion for maintaining the closing projection in the locking flap when accepted therein in a first locking position.

2. The latch of claim 1, wherein the closing projection comprises an outwardly extending tab for achieving the first locking position, a recess behind the outwardly extending tab for accepting the locking flap in a second locking position, and an upwardly extending shoulder between the outwardy extending tab and the recess, wherein when the latch is in the first locking position the locking flap is maintained on the outwardly extending tab, and wherein when the latch is in the second locking position the locking flap is maintained in the recess by the upwardly extending shoulder.

3. A container, comprising:

a cover portion;

a bottom portion; and a latch, comprising:

a closing projection extending out from a periphery of one of the cover portion and bottom portion; and a locking flap extending out from a periphery of the other of the cover portion and bottom portion, the locking flap comprising an aperture for accepting the closing projection and a rib situated on a face of the locking flap facing toward the other of the cover portion and the bottom portion for maintaining the closing projection in the locking flap when accepted therein in a first locking position.

4. The container of claim 3, wherein the bottom portion is compartmentalized.

5. The container of claim 3, wherein the cover portion comprises a top surface that is recessed for stacking another such container on top thereof.

6. The container of claim 3, wherein the cover portion and the bottom portion are hingedly connected.

7. The container of claim 3, wherein the closing projection comprises an outwardly extending tab for achieving the first locking position, a recess behind the outwardly extending tab for accepting the locking flap in a second locking position, and an upwardly extending shoulder between the outwardly extending tab and the recess, wherein when the latch is in the first locking position the locking flap is maintained on the outwardly extending tab, and wherein when the latch is in the second locking position the locking flap is maintained in the recess by the upwardly extending shoulder.

8. The container of claim 7, wherein when the latch is in either of the first locking position and the second locking position, the structure of the closing projection together with the aperture in the locking flap create an opening into the container.

9. The container of claim 3, wherein the cover portion comprises the closing projection and the bottom portion comprises the locking flap.

10. The container of claim 9, wherein the rib of the locking flap projects away from the cover portion.

11. The container of claim 3, wherein the locking flap is hingedly connected to the other of the cover portion and bottom portion.

12. The container of claim 3, wherein the container comprises a food container made of a rigid foam suitable for contact with food.

13. The latch of claim 3, wherein the locking flap is hingedly connected to the periphery of the other of the cover portion and bottom portion.

* * * * *

UNITED STATES PATENT AND TRADEMARK OFFICE

CERTIFICATE OF CORRECTION

PATENT NO. : 5,906,292

DATED : May 25, 1999

INVENTOR(S) : Edward W. Rider, Jr.

It is certified that error appears in the above-identified patent and that said Letters Patent are hereby corrected as shown below:

On the title page, and column 1, line 1

ITEM [54], delete "LATCH FOR CONTAINER" and replace with --LATCH HAVING LOCKING RIB AND CONTAINER THEREFOR--.

Signed and Sealed this

Twenty-first Day of September, 1999

*Attest:*

Q. TODD DICKINSON

*Attesting Officer*

*Acting Commissioner of Patents and Trademarks*